US008950748B1

(12) United States Patent
Herrmann et al.

(10) Patent No.: US 8,950,748 B1
(45) Date of Patent: Feb. 10, 2015

(54) SELF-ADJUSTING INSERT COMPILING AND REGISTRATION CLAMPING MECHANISM

(71) Applicant: Xerox Corporation, Norwalk, CT (US)

(72) Inventors: Douglas K Herrmann, Webster, NY (US); Jason M LeFevre, Penfield, NY (US); Derek A Bryl, Webster, NY (US)

( * ) Notice: Subject to any disclaimer, the term of this patent is extended or adjusted under 35 U.S.C. 154(b) by 0 days.

(21) Appl. No.: 14/064,227

(22) Filed: Oct. 28, 2013

(51) Int. Cl.

| | |
|---|---|
| ***B65H 9/16*** | (2006.01) |
| ***B65H 31/26*** | (2006.01) |
| ***B65H 31/34*** | (2006.01) |
| ***B65H 29/46*** | (2006.01) |
| ***B65H 31/36*** | (2006.01) |

(52) U.S. Cl.
CPC ..... *B65H 31/26* (2013.01); *B65H 31/34* (2013.01); *B65H 29/46* (2013.01); *B65H 31/36* (2013.01)
USPC ..... 271/252; 271/248

(58) Field of Classification Search
CPC ..... B65H 9/004; B65H 2301/331; B65H 2404/511; B65H 2404/54; B65H 2404/72; B65H 2404/696
USPC ..... 271/248, 252, 250, 251
See application file for complete search history.

(56) References Cited

U.S. PATENT DOCUMENTS 6,091,929 A 7/2000 Yamazaki et al.

*Primary Examiner* — Michael McCullough

(57) ABSTRACT

A self-adjusting clamp mechanism prevents sheets from migrating back during the compiling of sheets in a stacker. The mechanism consists of a spring-loaded ball bearing in a converging track placed just before a registration wall. The sheets would be scuffed under the ball bearing and against the registration wall. The track converges away from the registration wall such that: it allows sheets to enter freely against the registration wall; exerts little resistance for side tamping; and prevents the sheets from moving away from the registration wall as the ball bearing is driven tighter into the converging track.

20 Claims, 3 Drawing Sheets

SELF-ADJUSTING INSERT COMPILING AND REGISTRATION CLAMPING MECHANISM

This invention relates in general to an image forming apparatus, and more particularly, to an image forming apparatus employing an improved scuffing system.

Typically, in an electrophotographic printing process of printers, such as, U.S. Pat. No. 6,091,929, which is incorporated herein by reference to the extent necessary to practice the present disclosure, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface, which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

A finisher is usually arranged in a post processing position to receive the fused copy substrates or sheets and staple them, if desired. In many such finishing, tamping systems are commonly used to register the sheets in compiler trays. Sheets are usually scuffed against a lead edge (LE) registration wall of the compiler trays for various post finisher functions, such as, hole punching, corner stapling, edge stapling, sheet and set stacking, letter or tri-folding, Z-folding, Bi-folding, signature booklet making, set binding, trimming, post process sheet insertion, saddle stitching and others.

After sheets are conveyed onto a compiling shelf they are scuffed to the lead edge registration wall and need to then be tamped by inboard and outboard tampers to complete cross process registration. A current system incorporates an articulating scuffer that lifts the scuffer to allow the side tampers to register the sheets in the cross process direction. Unfortunately, when the scuffer is lifted the sheets that have been scuffed and had their LE registered against the registration wall can migrate back in the process direction when the scuffing force is not present due to the fact that the trail edges (TE) of the sheets are lower than the LE shelf on which they are positioned based on the architecture that has the media being compiled directly on a stack of media sets. The stack is approximately 7 mm below the LE shelf.

There is currently no mechanism or method to keep the sets from migrating away from the registration wall when the scuffer is lifted for engagement of the side tamping function and the sheets consistently migrate away from the registration wall. This impacts the inset registration which needs to be especially tight for stapled sets.

Also, registration issues are caused by the need to engage and disengage the scuffer during compiling to allow for side tamping of the compiled set. The scuffer is used to drive the individual sheets against the registration wall but the drive forces/frictional load of the scuffer cannot be overcome by the side tampers to allow side tamping/registration. To accommodate side registration, the scuffer must be lifted to allow for the sheets to be tamped from the side.

Unfortunately, as soon as the scuffer is lifted, the sheets migrate away from the LE registration wall. This can result, for example, from situations where the TE of the sheets are lower than the LE of the sheets and the sheets drift down and back away from the LE registration wall. This situation becomes worse as the stack becomes more uneven due to curl and staple build up leading to an increase in the height difference from the LE shelf and the top of the stack.

Obviously, there is still a need for an improved compiling and registration finishing apparatus and method.

Accordingly, an improved self-adjusting clamping mechanism is disclosed that prevents sheets from migrating back during the compiling of sheet in a stacker. The self-adjusting mechanism includes a spring-loaded ball bearing in a converging track placed just before the registration wall. Sheets are scuffed under the ball bearing and against the registration wall. The track converges away from the registration wall such that: it allow sheets to enter freely against the registration wall; exerts little resistance to side tamping; and simultaneously prevents the sheets from moving away from the wall as the ball bearing is driven tighter into the converging track.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

FIG. 2 is a partial schematic top view of the compiler and registration apparatus of the present disclosure showing a single clamping mechanism.

Figure 1:
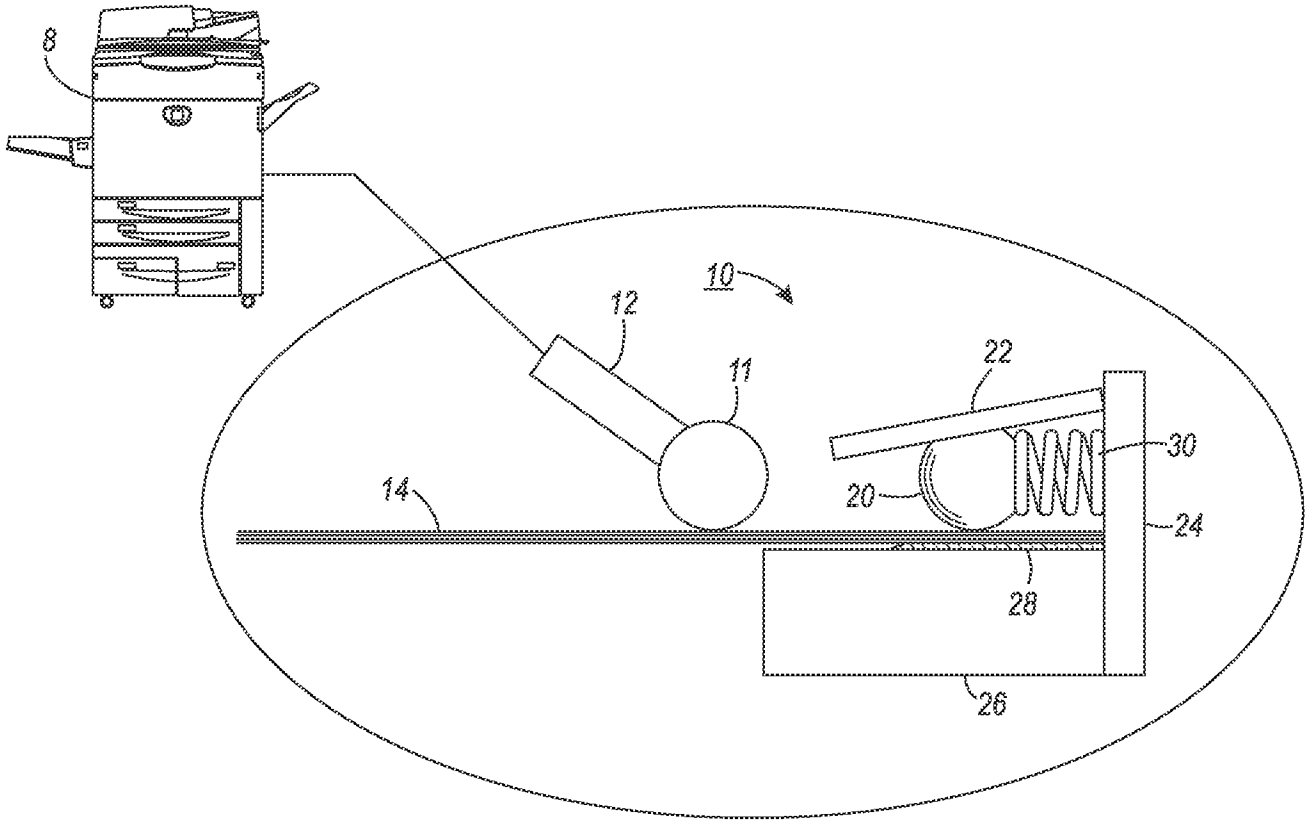
FIG. 1 is a partial side view and FIG. 2 is a partial top view of a compiler and registration apparatus of the present disclosure showing a clamping mechanism component layout during compiling.
Figure 2:
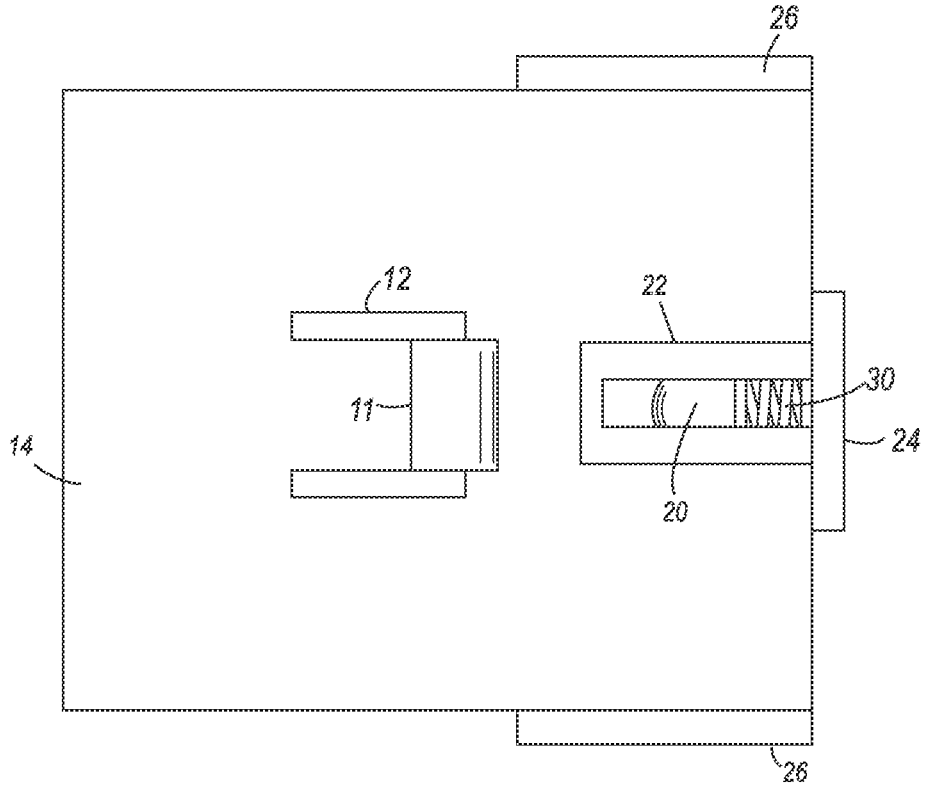

In FIGS. 1 and 2, a conventional electrostatographic printer apparatus 8 includes a compiler 10 that compiles sheets in accordance with the present disclosure comprising a self-adjusting clamping mechanism for the LE of the sheets that: allows each sheet to be freely scuffed against a LE wall 24; allows the sheets to be side tamped with low resistance; and simultaneously clamps the sheet(s) and prevents motion in the reverse process direction—even after scuffer roller 11 of a conventional scuffer mechanism is lifted for side tamping.

Compiler 10 includes a shelf 26 onto which media or sheets 14 are conveyed by drive roll 11 cantilever mounted by supports 12. Sheets 14 are supported by shelf 26 and are driven for registration against registration wall 24. A directional one-way grass 28 in positioned on a sheet support side of the shelf secures the first and following sheets as additional sheets are added by drive roll 11. The one-way grass 28 significantly raises the sheet to shelf friction in one direction and the subsequent sheet to sheet friction is used to hold any additional media together. Devices other than one-way grass could be used to hold the first sheet and the following sheets of a set, for example, a vacuum system, sandpaper, etc., if desired. A clamping mechanism is included that comprises a spring loaded ball 20 mounted in a converging track member 22 and the top portion of shelf 26 that acts as a one-way clutch. This allows the incoming media to be scuffed with low force to lead edge registration wall 24 and allows side to side tamping, but simultaneously limits any paper motion in the upstream process direction. Since ball 20 is loaded by spring 30, the ball clamp allows ease of movement when it is pushed in the diverging direction of the track but if the media is "pulled" back the ball is forced in the diverging direction and puts a high locking force on the media set which creates a self-adjusting clamping force as each sheet is added to the set being compiled. Ball 20 is free to rotate in all directions except when it is rotated clockwise (from the operator side) when the media attempts to migrate away from wall 24. This is accomplished by placing the ball in the converging track that drives ball 20 tighter as the media attempts to rotate the ball clockwise. Compression spring 30 is applied to the ball to set an initial loading that helps to limit the travel of the ball and limits the ability of the media to move away from the LE registration wall 24.

Compression spring 30 is used to both: apply a setting force in a horizontal direction; and to keep ball 20 seated against the angled track/guide 22. This ensures that each incoming sheet will rotate ball 20 away from the converging guide while also ensuring minimal movement of the ball away from the converging guide. This allows the ball to lock and create a high force down against the compiled set. As the set continues to build the ball incrementally shifts towards the registration wall to accommodate more sheets while continuing to provide the necessary clamping function. The entire system is released through conventional means during eject allowing the newly compiled/stapled set to be ejected from the compiler apparatus.

Figure 3:
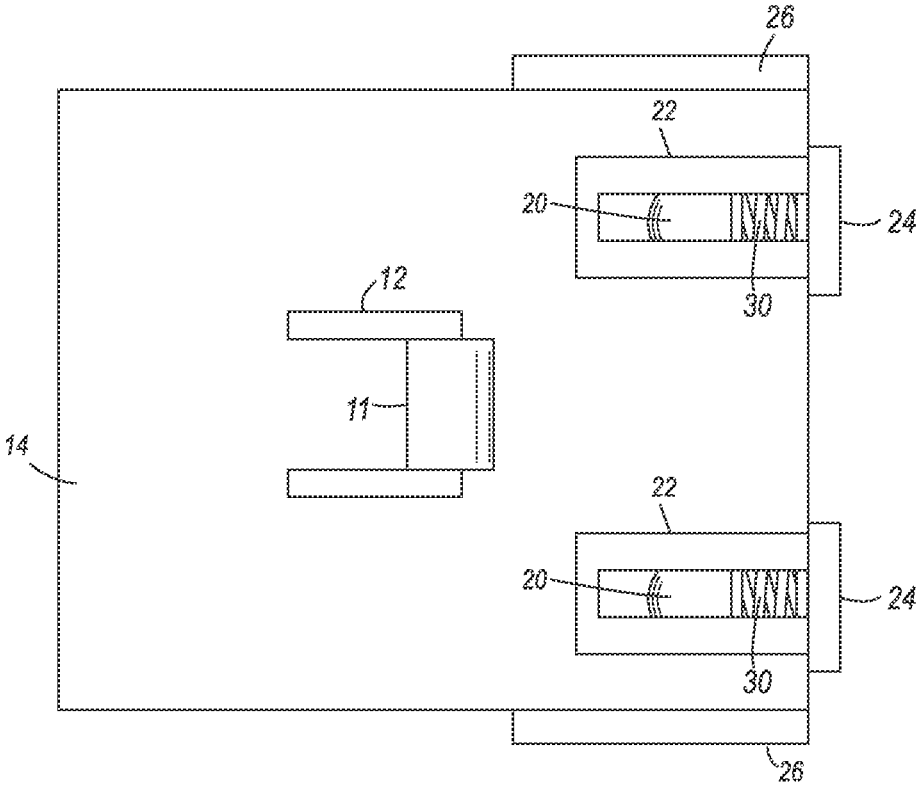
FIG. 3 is a partial schematic top view of the compiler and registration apparatus of the present disclosure showing a dual clamping mechanism.

An alternative embodiment of the present disclosure is shown in FIG. 3 that is identical to the embodiment of FIG. 1 except that an additional clamping mechanism is employed to register media against registration wall 24.

It should now be understood that a self-adjusting clamping mechanism to be used in a media set compiling apparatus has been disclosed that relies on the use of a ball that is free to rotate in all directions except when the ball is rotated clockwise when the media attempts to migrate away from a LE registration wall. The ball is placed into a converging track that drives the ball tighter as the media attempts to rotate the ball clockwise. A compression spring is applied to the ball to set an initial loading that helps to limit the travel of the ball and limits the ability of the media to move away from the LE registration wall. Advantages of the self-adjusting clamping mechanism of the present disclosure include: using a converging guide and ball to allow scuffing and side tamping while simultaneously providing self-adjusting clamping force; allowing the use of a releasable scuffer for side tamping sheets when a non-flat or flat compiling station is used; holding multiple sheets for compiling by applying a horizontal reaction force to a ball and converging guide with one-way grass to provide a multi-sheet holding mechanism; and the using the self-adjusting clamping system for forward process and cross process movement while restricting reverse process motion to allow both LE and cross process registration while maintaining process registration at a LE wall.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A compiling apparatus, comprising:
- a shelf onto which media is conveyed;
- a registration wall connected to said shelf;
- a drive mechanism for conveying said media onto said shelf;
- a scuffer mechanism for scuffing said media against said registration wall; and
- a self-adjusting clamp mechanism that prevents said media from migrating back from said registration wall during compiling of said media in said compiling apparatus, said self-adjusting clamp mechanism including a spring-loaded ball bearing in a converging track placed just before said registration wall.

2. The compiling apparatus of claim 1, wherein said converging track converges away from the registration wall such that it allows said media to enter freely against said registration wall while simultaneously preventing said media from moving away from said registration wall as said spring-loaded ball bearing is driven tighter into said converging track.

3. The compiling apparatus of claim 1, including multiple self-adjusting clamp mechanisms.

4. The compiling apparatus of claim 1, including a media movement inhibiting member positioned on a media support side of said shelf in order to secure a first and following media as additional media is added by said drive mechanism.

5. The compiling apparatus of claim 1, wherein said compiling apparatus is incorporated into a xerographic device.

6. The compiling apparatus of claim 1, wherein said self-adjusting clamp mechanism is adapted to accommodate multiple media sets.

7. The compiling apparatus of claim 1, wherein said shelf is angled with respect to a horizontal plane.

8. The compiling apparatus of claim 4, wherein said media movement inhibiting member positioned on said media support side of said shelf has at least a portion thereof angled towards said registration wall.

9. The compiling apparatus of claim 8, wherein said self-adjusting clamp mechanism uses non-gradational force to provide horizontal clamping of said media.

10. The compiling apparatus of claim 1, wherein said self-adjusting clamp mechanism is adapted to accommodate multiple media sets.

11. A printer including a compiling apparatus for compiling individual sheets into sets with said compiling apparatus comprising:
- a shelf onto which said sheets are supported;
- a registration wall connected orthogonally with respect to said shelf;
- a drive mechanism for driving said sheets onto said shelf; and
- a self-adjusting clamp mechanism that prevents said sheets from migrating back from said registration wall during compiling of said sheets in said compiling apparatus, said self-adjusting clamp mechanism including a roller that is spring-loaded within a converging track placed just before said registration wall.

12. The printer of claim 11, wherein said converging track allows said sheets to enter freely against said registration wall while simultaneously preventing said sheets from moving away from said registration wall as said ball bearing is driven tighter into said converging track by said sheets.

13. The printer of claim 11, including multiple self-adjusting clamp mechanisms.

14. The printer of claim 11, including a sheet movement inhibiting member adapted to secure a first and following sheets as additional sheets are added by said drive mechanism.

15. The printer of claim 14, including a scuffer mechanism for scuffing said sheets against said registration wall.

16. The printer of claim 14, wherein said media movement inhibiting member positioned on said media support side of said shelf has at least a portion thereof angled towards said registration wall.

17. A method for compiling sheets, comprising:

providing a shelf onto which sheets are compiled;

connecting a registration wall orthogonally with respect to said shelf;

driving said sheets onto said shelf; and preventing said sheets from migrating back from said registration wall during compiling of said sheets with a self-adjusting clamp mechanism, said self-adjusting clamp mechanism including a spring-loaded ball bearing within a converging track placed just before said registration wall.

18. The method of claim 17, including angling said converging track away from said registration wall and thereby allowing said sheets to be moved freely against said registration wall while simultaneously preventing said sheets from moving away from said registration wall as said spring-loaded ball bearing is driven tighter into said converging track.

19. The method of claim 18, including scuffing said sheets against said registration wall.

20. The method of claim 18, including positioning said ball bearing with respect to said converging track such that it is free to rotate in all directions except when said ball bearing is rotated in a predetermined direction when said sheets attempt to migrate away from said registration wall.

* * * * *